US005112635A

United States Patent [19]

Liebermann

[11] Patent Number: 5,112,635

[45] Date of Patent: May 12, 1992

[54] METHOD OF SAFE HIGH SPEED SLICING/SHAVING OF A FOOD PRODUCT

[75] Inventor: Benno E. Liebermann, Louisville, Ky.

[73] Assignee: Beltec International, Louisville, Ky.

[21] Appl. No.: 621,145

[22] Filed: Dec. 3, 1990

[51] Int. Cl.[5] ..... B26D 1/00

[52] U.S. Cl. ..... 426/518; 83/592

[58] Field of Search ..... 426/518; 83/356, 417, 83/592, 596, 673

[56] References Cited

U.S. PATENT DOCUMENTS

| | | | |
|---|---|---|---|
| 23,966 | 5/1859 | Vine | 83/592 |
| 4,277,995 | 7/1981 | Sontheimer | 83/592 |
| 4,368,657 | 1/1983 | Pellaton | 83/592 |
| 4,867,994 | 9/1989 | Perrine | 426/518 |

*Primary Examiner*—George Yueng
*Attorney, Agent, or Firm*—Wallenstein, Wagner & Hattis, Ltd.

[57] ABSTRACT

A slicing/shaving method includes the steps providing a slicing/shaving edge of a generally arcuate configuration, rotating the slicing/shaving edge along a circular path of travel with the slicing/shaving edge disposed at an angle other than parallel thereto, and guiding a food product along a food product feed path disposed generally transversely to the slicing/shaving edge whereby continuous rotation of the slicing/shaving edge along the circular path effects continuous slicing/shaving of the fed food product.

29 Claims, 6 Drawing Sheets

FIG. 1
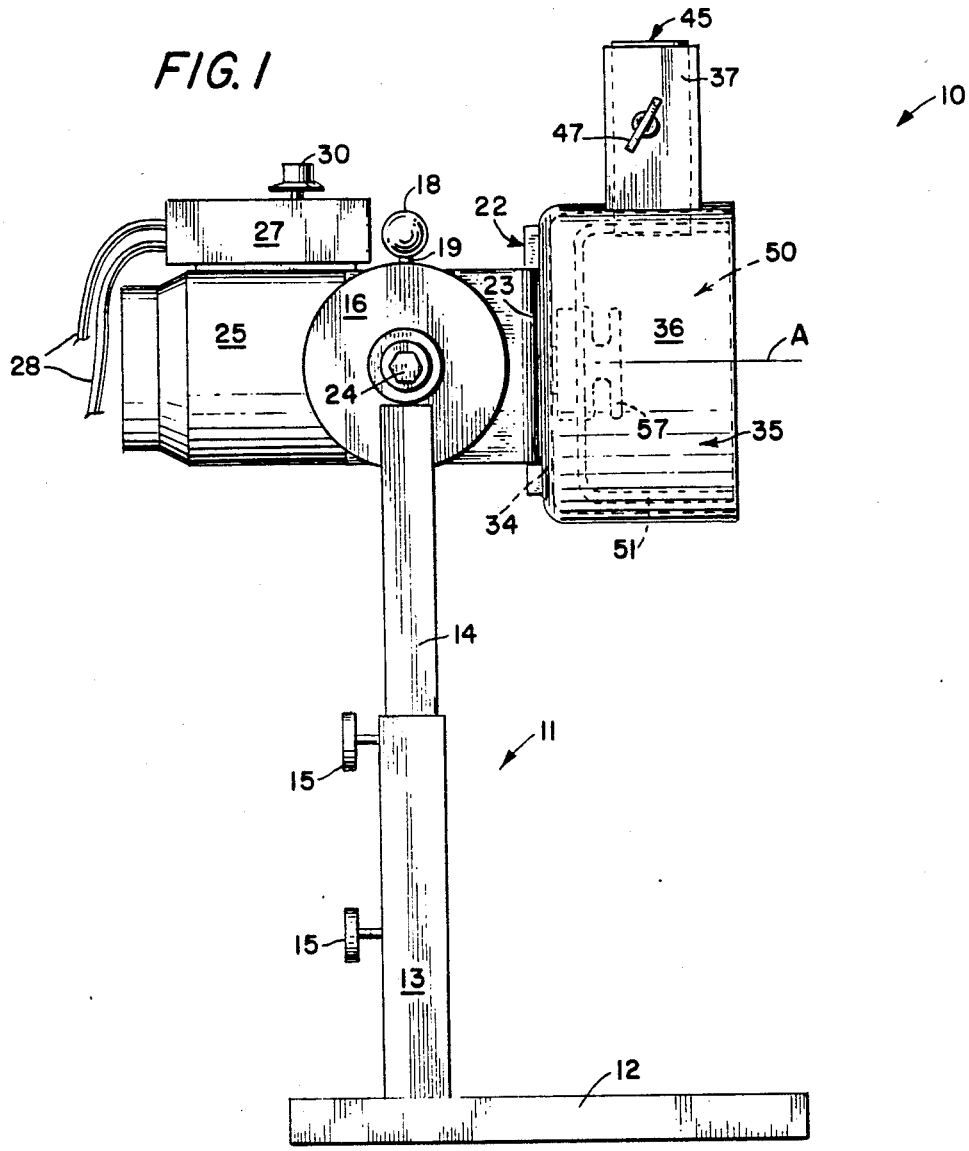
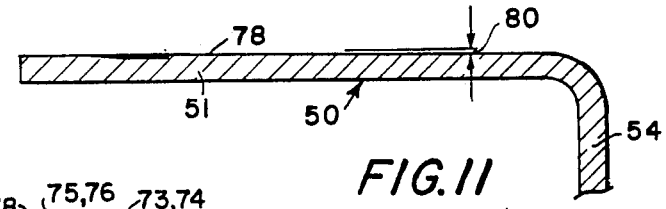
FIG. 11
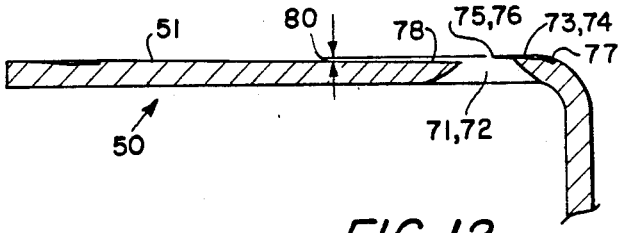
FIG. 12

FIG. 13
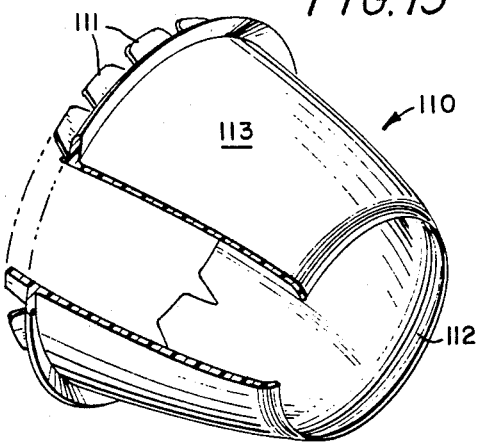
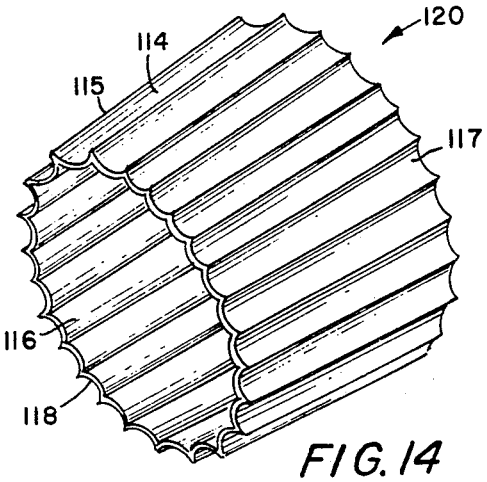
FIG. 14
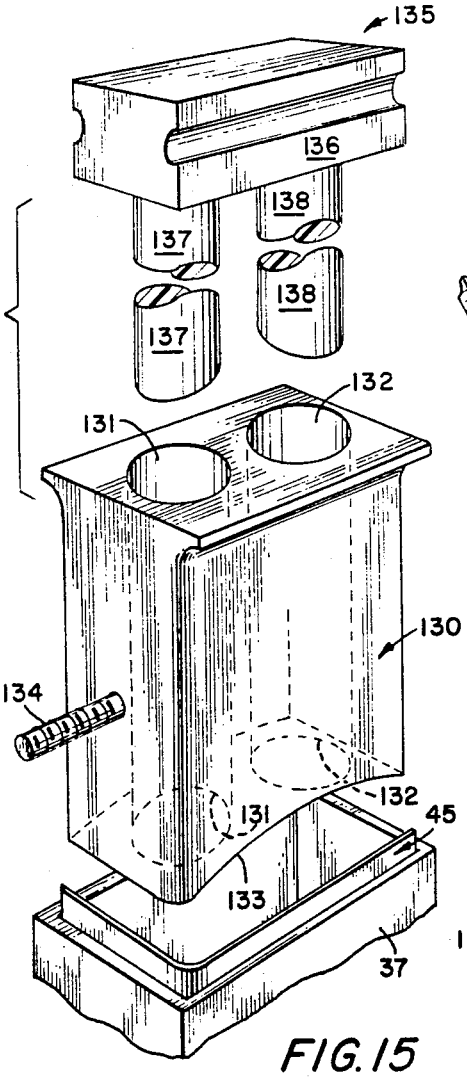
FIG. 15
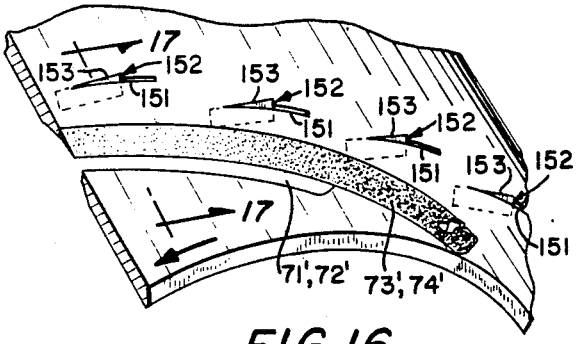
FIG. 16
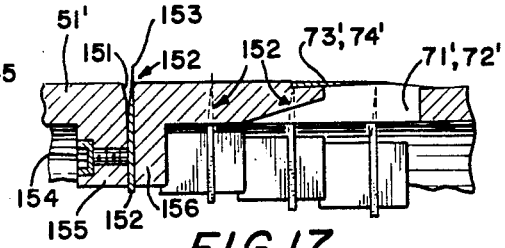
FIG. 17

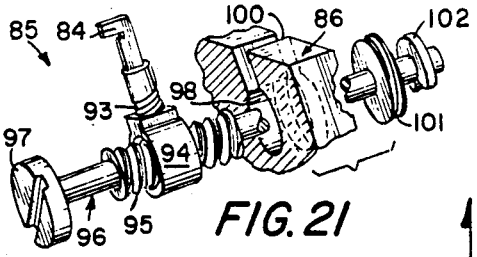
FIG. 21
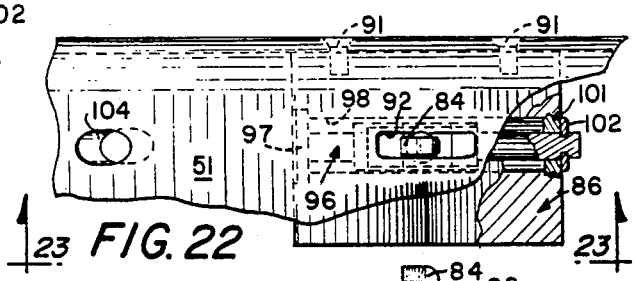
FIG. 22
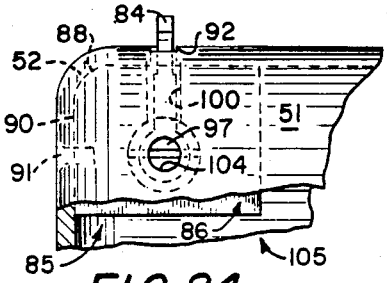
FIG. 24
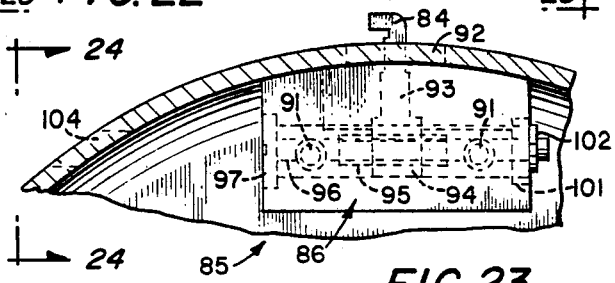
FIG. 23
FIG. 20
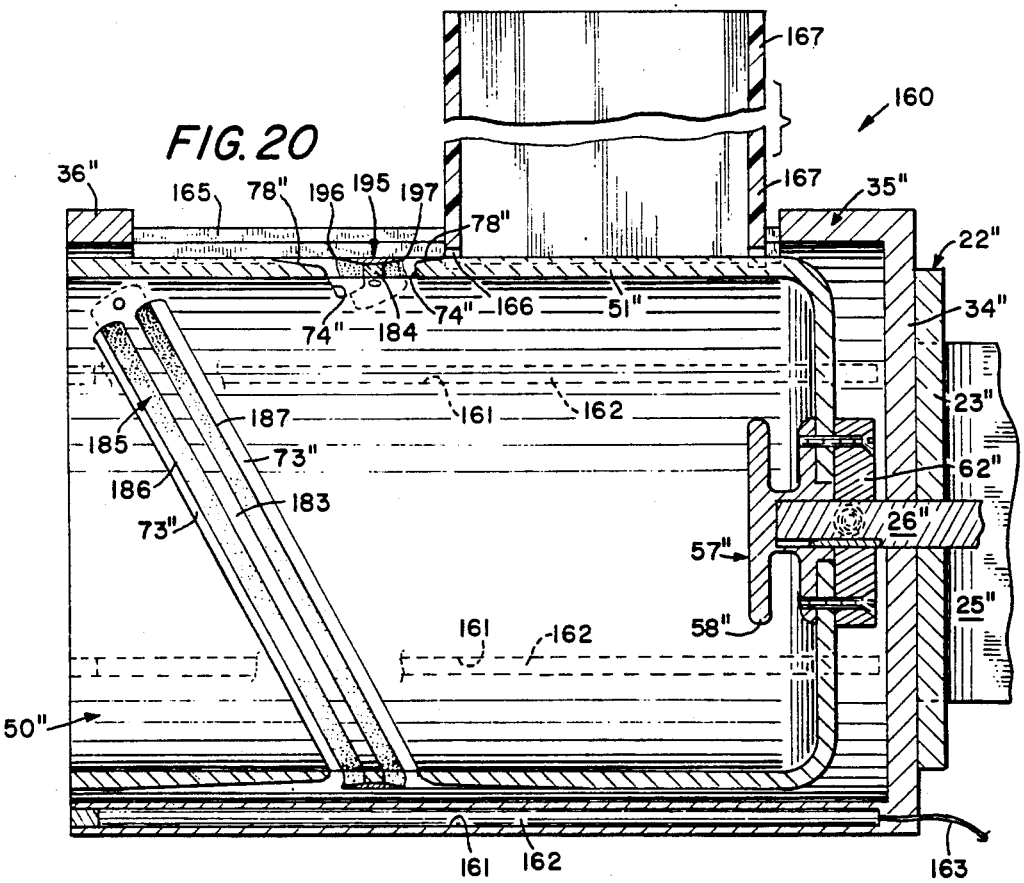

METHOD OF SAFE HIGH SPEED SLICING/SHAVING OF A FOOD PRODUCT

BACKGROUND OF THE INVENTION

In the present era of increasing demands for higher production efficiencies, increased speeds, containment and reduction of qualified labor costs, of which there is a diminishing supply, it is highly desirable to achieve increased production efficiencies through the utilization of novel and unobvious methods and processes. Such novel and unobvious methods and processes of safe high speed slicing/shaving of food products, as specifically disclosed, described and illustrated hereinafter, forms the subject matter of the present disclosure.

In today's economic environment of constantly increasing inflationary trends and escalating cost pressures, the food processing industry is continuously seeking sophisticated methods and processes which will increase the yield and thus the profit which is achieved from converting livestock, vegetable and like commodities into consumer goods, particularly such consumer goods as are designated for mass marketing in the sliced bulk wholesale field or the sliced and portion controlled retail field. These categories of products reflect a common denominator, namely, the requirement to "slice" the product from a "single mass" into a sliced or shaved portion of a controlled thickness and/or configuration. Whether sliced or shaved, such products can also be subsequently ground, minced, columnated, sectioned and/or formed into a desirable unit configuration compatible to unilateral practiced slicing methodology.

Irrespective of the specific product processing procedure or the eventual end product involved, in those cases in which the final product is an edible product, the "mouth feel" and "taste," i.e., organoleptic senses, are perhaps the most important attributes of the product. The consumer will make a subconscious assessment based upon his or her visual and aromatic experience of the product, but "mouth feel" through biting and chewing will to a large extent determine the end user's acceptance preference or rejection of the overall product. Accordingly, product quality assessment by the ultimate mass consumer is to a large extent influenced by the perception of the ultimate consumer and that perception to a great measure is influenced by the thickness of the sliced or shaved product. Extensive research conducted by the food processing industry has demonstrated that the thinner a product is sliced when used for consumer consumption, as in a sandwich, the more increased is the aromatic and/or organoleptic intensity achieved and experienced by the user. Thus, shaved and thinly sliced product effects optimum tenderness during biting and chewing and increases the perception intensity of product taste. Accordingly, the thinner a product is sliced or shaved, generally the more superior is its actual and perceived qualities.

The difficulty with a very thinly sliced/shaved product is the difficulty in maximizing slicing speed with commensurate sliced product yield while at the same time maintaining bacteriological product safety (absence of contamination) and minimizing accidental injury hazards (sliced fingers, etc.) when practicing conventional reciprocating slicing methods. A high speed practical but dangerous slicing method is unacceptable to the industrial, commercial and domestic product slicing and product retailing markets. Unavailable to the latter markets are, until the present invention, slicing/shaving methods which maximize slicing speed and sliced product yield while at the same time effecting bacteriological product safety and minimizing accidental injury.

Present industrial high speed slicing methods achieve slicing speeds of up to 800–900 slices per minute. These are practiced utilizing highly automated complex computer controlled high speed slicing machines which range in cost between $100,000 and $200,000 per machine. Such high speed slicing machines are exemplified by the flying-rotating half-moon knife, and various continuous band knives over which the product is reciprocated to achieve uniform slicing repetition. However, such high cost machines do not serve nor are they acceptable by the small retail commercial and domestic markets where the product is fed in a reciprocating motion perpendicularly toward a rotating slicing blade. These slicing machines might achieve a maximum of sixty strokes or thirty slices per minute if the operator's manual skills are high, but without automatic slicing machines of this type, fifty strokes or twenty-five slices per minute are more the norm. These conventional rotary slicing blade machines are utilized worldwide because of the low cost, but they are operationally dangerous, thus consequently causing thousands of personal injuries during daily operation, cleaning sanitation and maintenance procedures.

SUMMARY OF THE INVENTION

The novel method of the present invention preferably utilizes a slicing/shaving machine in the form of a drum slicing/shaving machine which increases slicing efficiency by at least 400% and up to 1000% when measured against a conventional round blade surface speed slicing machine (both machines being presumed to have identical cutting edge diameters). The drum slicing/shaving machine includes a slotted cylindrical body carrying a slicing/shaving blade disposed at an angle to the axis of rotation of the drum slicing/shaving machine toward and against which the product is moved along a path generally transverse to the direction of drum body rotation. The drum body can as well be slotted at two or more positions and carry two or more slicing/shaving blades/edges which additionally increases cutting speed/slices per minute. The slicing/shaving blade or blades are preferably flexible disposable straight blades hollow ground on one or both cutting edges, and each blade or blades are longitudinally adjustably tensioned in a manner which regulates and adjusts slice thickness. Each blade (or blades) is secured to the drum body with a center point of the blade being located precisely on a radial line emanating from the axis of rotation of the drum body to achieve optimum slicing/shaving efficiency.

In one example of the drum slicing/shaving method of the present invention, the drum body has a diameter of approximately 7" with two perpendicular slots each disposed at a 30° angle and adjacent each is secured a blade of 9" length. The latter represent a combined effective slicing/shaving edge of approximately 14–15". Assuming a drum body speed of 400 RPM, an effective slicing quantity of 800 slices per minute is effectively achieved. The latter represents a significant production speed increase of approximately thirty times faster than a conventional round blade slicing processes. In other words, the present invention as just described increases efficiency 3000% over conventional methods utilizing a round blade slicing machine having a 12" slicing blade. The latter is also achieved with commensurate minimization of potential injury to the operator during operation, cleaning sanitation and maintenance as compared to conventional reciprocating round blade slicing equipment. The latter is effectively achieved by virtually wholly housing the drum body and the slicer/-shaver blades carried thereby so that the high speed rotating slicing/shaving drum body is inaccessible to an operator's fingers or hands. The housing preferably includes an extended product feed guide which prevents accessibility of an operator's hand or fingers to the rotating drum body and the blades carried thereby.

In further accordance with the invention, the slicing/shaving blades are readily installed and replaced upon the drum body, and the drum body is easily and instantly detached and attached to a drive shaft of the slicing/shaving machine for such purposes as daily cleaning, repair and/or required sanitation procedures. The drum body is also preferably manufactured from anodized aluminum or similar metal or polymeric/-copolymeric material which also can be teflon coated to achieve a low coefficient of friction between the product and the revolving/rotating drum body during high speed slicing/shaving. If the drum body is constructed from polymeric/copolymeric material, it is preferably injection molded to a number of different diameters so that a user might have in hand different diameter drum heads for accommodating the slicing/shaving of a variety of different food products, affecting thickness, profile and length.

The slicing/shaving blades are also relatively inexpensive to manufacture and are preferably made from noncorrosive rolled and hollow ground steel of various profile configurations suitable for specific food product slicing/shaving operations. The cutting edge of the disposable slicing/shaving blade(s) can be serrated, indented, or smooth to achieve a particular profile of the sliced/shaved product and optimum slicing/shaving thereof.

The number of slicing/shaving blades can vary relative to each slicing/shaving drum body. The blades are disposed about the drum body periphery so as to assure dynamic equalization of eccentric balancing forces developed during high speed revolution of the drum body. For example, if two blades are utilized, they are spaced 180° from each other whereas three blades are spaced 120° from each other and four blades are spaced 90° from each other. The latter arcuate or peripheral spacing of adjacent shaving/slicing blades dynamically neutralizes any vibration of the revolving drum body. The reduction/elimination of eccentric vibration prevents operational hazards at high slicing/shaving speeds. The absence of vibration also assures that all slices of a particular product are of substantial uniform thickness and size, shape and consistency.

For "normal" slicing/shaving procedures, the slicing blades are preferably manufactured from suitable noncorrosive rolled and hollow ground steel with the blade edge being relative straight and uniplanar. However, the cutting edge of the disposable slicing/shaving blades can be serrated, indented, etc. with the selection being predicated by the specific end product desired and/or optimum slicing efficiencies obtainable thereby. The material from which the blades are constructed might well vary depending upon the particular product being sliced or shaved. For example, the slicing/shaving machine of the present invention can be utilized to slice/shave such products as cheese, red meat, pork, fowl, fish or similar aquatic products, fruits and vegetables, etc. Farinaceous food products, such as flour, starches, nuts, potatoes, etc., can also be sliced/shaved by the slicing/shaving method of the present invention. No matter the particular product which is to be sliced/-shaved, the slicing/shaving blade and the particular size drum can be designed to achieve a specific end product of a desired consistency, size, thickness, configuration, etc.

However, no matter what the particular product, the slicing/shaving achieves a repetitious desired configuration/thickness currently unachievable economically when measured and compared to current prior art slicing and/or shaving methodologies.

Another very important aspect of the present invention relates to bacteriological safety risks which are highly prevalent in association with conventional round slicing blade equipment because of the exposure of the round rotating blade of the latter to environmental bacteriological contamination. Such round slicing blades must be frequently sanitized, but more often such does not occur and bacteriological contamination results. However, the present invention essentially eliminates and at a maximum minimizes bacteriological safety risks through the utilization of a heated housing which essentially encapsulates the slicing/shaving drum which minimizes environmental bacteriological contamination exposure significantly, particularly when compared to conventional cold slicing techniques. The direct achievable benefit of hot drum slicing in keeping with the present invention is to enable the heated drum housing to heat the drum body and the slicing knives and to thereby hot-cut the product at safe product exposure temperatures ranging from 140° F. to 240° F. or higher. Thus, the products are sliced extremely thin and during slicing the temperature thereof can be raised anywhere from 40° F. to 145° F. minimum through induction essentially instantaneously cooking the product during the slicing/shaving thereof. In other words, during the rotation of he heated drum and the slicing friction caused by each slicing/shaving blade, the overall temperature of each slice is raised to at least 145° F. eliminating the need to preheat or cook a solid cold food product prior to slicing. For example, a hot ham sandwich could be made by simply slicing cold ham and during the slicing of the cold ham the temperature would be increased to a least 145° F. per slice. Obviously, in a fast food restaurant, delicatessen or the like, hot ham, pastrami, corn beef, roast beef or similar sandwiches could be made without pre or post heating. The product need but be sliced, and during slicing the thin/-shaved pieces are heated to render them bacteriologically safe, and sufficiently hot to be considered by a consumer as a "hot" sandwich. Even a virtually raw, i.e., "fresh" product refrigerated at 40° F. or frozen at 24° F. or above can be instantly "cooked" simply by hot-slicing through the product. Instantaneous cooking or heating is achieved by conduction of the product to the hot shaving/slicing blades and drum surface as an extremely thin cross section of the cold or frozen raw product is sliced or shaved by the revolving heated slicing/shaving blades. Obviously, the end product cooked temperature of 145° F. to 165° F. from a fresh cold product temperature range of between 24° F.–40° F. will depend on the drum body temperature, but the latter can be optimally achieved and temperature controlled through electrical cal rods or similar resistance heaters provided with electonic thermostat control means.

In further keeping with the present invention, the drum body is preferably rotated at any one of a variety of different rotational speeds, and the thickness of each slice can also be varied, and the latter two functions when combined will determine the repetitious doneness of each cooked slice of meat, etc. achievable and presentable to the consumer. For example, if one were cutting roast beef at a temperature of 40° F. upon a drum body of 7" diameter having two smooth slicing/-shaving blades disposed 180° relative to each other and tensioned a predetermined amount, the combination would produce at each cut a slice of a precise thickness and a precise temperature. In order to increase the sliced temperature, one might, for example, slow down the drum body rotation or increase the temperature, or a combination of both. Obviously, the thickness of each slice could be adjusted by varying the tension of the slicing/shaving blade as will be described more fully hereinafter. However, in all cases serially sliced/shaved product will be heated/precooked at a repetitious temperature and a repetitious thickness (thinness) heretofore unachievable by conventional practiced methods currently in, for example, the fast food industry (Hardee's, Arby's, etc.).

In further accordance with the present invention, a novel reciprocating product feed chute is also provided and associated with the slicing/shaving apparatus enabling the portion control of sliced increments of 2-3-4-5-6 ounces of product which can be guided toward and upon a suitable digital scale for precision portion control measurement. Whatever the particular accumulated ounces might be, these can be utilized on a per sandwich basis. Furthermore, because the slices are so thin, during manual operation, the operator must apply pressure to the product to apply slicing/shaving. Thus, during slicing/shaving the operator applies manual pressure until, for example, the digital scale reads 3 oz. Manual pressure is immediately released and the slice-shaved operation is effectively instantly rendered ineffective. The latter cannot be achieved by a conventional rotating blade/revolving blade operation because the product is continuously cut as the product is gravity fed absent manual pressure. Thus, current round blade reciprocating motion slicing machines require the completion of a slicing stroke motion irrespective of sliced thickness before a single slicing stroke can be terminated and this does not provide for precise weight portion control in fractions of an ounce. Absent precise weight control in fractions of an ounce, high priced food products which are sliced for sandwich purposes and served in the millions can cost the operator franchisee/franchisor considerable money. For example, roast beef, ham, turkey, etc. are high priced delicatessen commodities ranging from $2.00 to $4.00 per pound wholesale, and $5.00 to $10.00 retail. If these products are sliced in imprecise weight fractions and served in sizes beyond that required to achieve a specific profit margin per sandwich, the individual consumer profits by the error, but the delicatessen owner, franchisee/-franchisor loses a tremendous amount of money when one appreciates the millions of individual sandwiches that are sold annually.

The slicing/shaving process of the invention is also practiced utilizing a machine having a product feed chute in which two or more products can be fed simultaneously, such as roast beef and ham; ham and cheese; corn beef and pastrami; or any other two or more combinations thereof. Two or more of such products will then be cut simultaneously to produce an admixed product sandwich, such as shaved corn beef and pastrami or beef and cheese, and this will be done in the absence of the separate slicing of the separate products, separate weighing thereof, and separate physical assembly of the singularly sliced products. The latter prevents tedious labor and its attendant cost while significantly increasing speed and efficiency.

In further accordance with the present invention, the slicing/shaving method includes the utilization of a series of knives protruding from the surface of the drum which are generally disposed parallel to each other and parallel to the direction of rotation. In this fashion product can be sliced longitudinally into thin strips, or a product, such as an onion, can be repetitiously and uniformly diced or shredded in a single operation, which is essentially impossible under today's slicing techniques.

With the above and other object in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 1 is a side elevational view of a novel high speed slicing/shaving apparatus/machine for practicing the novel method of the present invention, and illustrates a variable speed motor adjustably mounted upon a pedestal for rotating a cylindrical slicing/shaving body within an exterior cylindrical housing carrying a product feed/guide chute.

FIG. 2, is a front elevational view of the slicing/shaving machine of FIGS. 1 through 3, and illustrates the axes of the variable speed motor, the housing and the slicing/shaving body in a vertical plane.

FIGS. 2 and 4, is an enlarged fragmentary sectional view of a portion of the slicing/shaving body, its slot, the slicing/shaving blade and an adjustable guard within the food/guide chute.

FIGS. 3 and 5 is a rear perspective view of the slicing/shaving body, and illustrates the same removed from a shaft of the variable speed motor.

FIGS. 2, 4 and 6, is a fragmentary view of another pin carried by the slicing/shaving body for securing an opposite end of one of the slicing/shaving blades to the slicing/shaving body.

FIGS. 11 and 12, Which are illustrated on the sheet of drawings containing FIG. 1, are enlarged fragmentary cross-sectional views taken respectively along lines 11, 11 and 12, 12 of FIG. 7, and illustrate the manner in which an exterior surface of the slicing/shaving body is tapered or raked from a plane through a slicing/shaving edge of the slicing/shaving blade.

FIG. 13 is a fragmentary perspective view, and illustrates a generally tapered and tubular product delivery chute which is snap-fit along a serrated edge upon a circumferential edge of the housing.

FIG. 14 is a perspective view of another product delivery chute, and illustrates continuous flutes for reducing product friction.

FIG. 15 is a fragmentary perspective view of an insert and a plunger device, and illustrates adjacent respective cylindrical product feed channels and product plungers.

FIG. 16 is a fragmentary perspective view of another slicing/shaving body of the present invention, and illustrates a plurality of radially spaced cutting blades carried by a peripheral wall of the slicing/shaving body to additionally create strips of the product in addition to the slicing/shaving thereof.

FIG. 17 is an enlarged fragmentary cross-sectional view taken generally along line 17—17 of FIG. 16, and illustrates the mounting of one of the radially disposed cutting blades.

FIG. 20 is an enlarged axial cross-sectional view taken generally along line 20—20 of FIG. 18, and illustrates details of two pairs of twin slots each partially spanned by an associated slicing/shaving blade to effect slicing/shaving of a product upon either clockwise or counterclockwise rotation of the slicing/shaving body.

FIG. 21 is a fragmentary perspective view of the slicing/shaving blade tensioning mechanism of FIG. 8, and illustrates details thereof.

FIG. 22 is a fragmentary top perspective view, and illustrates an opening in the cylindrical wall of the slicing/shaving body to rotate the screw and adjust the tension of the slicing/shaving blade.

FIG. 23 is cross-sectional view taken generally along line 23—23 of FIG. 22, and illustrates the alignment between the tensioning screw and the opening in the cylindrical wall of the slicing/shaving body.

FIG. 24 is a fragmentary view taken generally along line 24—24 of FIG. 23, and illustrates the alignment between the access opening in the periphery of the slicing/shaving body and the head of the tensioning screw.

DESCRIPTION OF THE PREFERRED EMBODIMENTS

Figure 2:
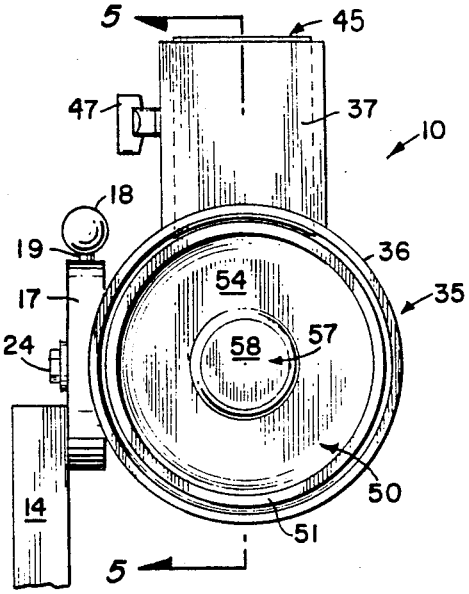
FIG. 2 is a fragmentary front elevational view of the slicing/shaving machine, and illustrates the slicing/-shaving body disposed in generally concentric relationship to the housing thereof.
Figure 4:
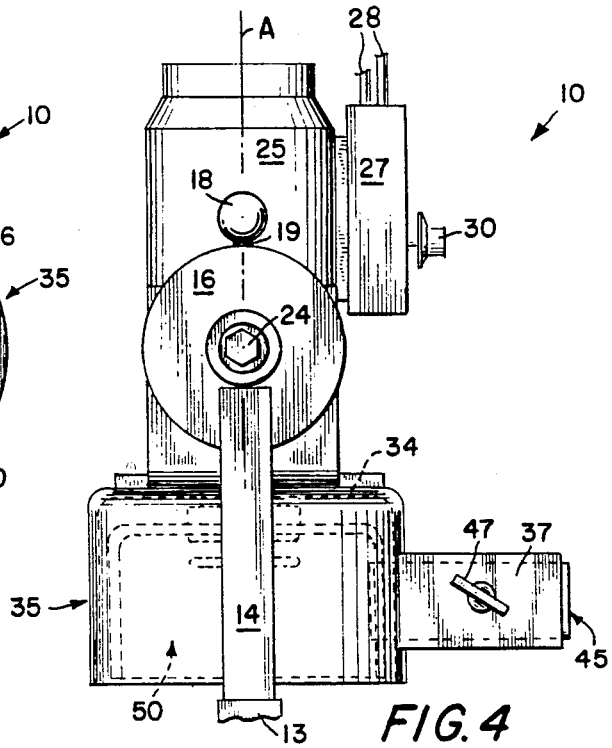
FIG. 4, which appears on the sheet of drawing containing

The novel method of the invention will be best understood and appreciated from the following description of an apparatus or machine for slicing/shaving a product, and particularly a variety of different food products, illustrated in FIGS. 1 through 10 of the drawings which is generally designated by the reference numeral 10.

The slicing/shaving machine 10 includes a pedestal 11 defined by a relatively heavy and substantial base 12 having welded thereto a tube 13 which is preferably of a transverse rectangular cross-sectional configuration, although the latter might also be cylindrical or circular. The tube 13 receives a post 14 in internal telescopic sliding relationship thereto, and the tube 13 and post 14 can be relatively locked in virtually any desired position of vertical adjustment by manual set screws 15 which are received in threaded openings (not shown) and have terminal ends (not shown) which engage the exterior of the post 14 in a conventional manner.

An upper end of the post 14 is welded to a circular plate 16 having a cylindrical flange 17 which in turn carries a round handle 18 fixed to a stem 19 which is slidable relative to an opening (unnumbered) in the flange 17. A conventional spring (not shown) normally biases the stem 19 radially inwardly in which position it can engage in any one of a number of holes (not shown) formed in a flange (not shown) interiorly of and concentric to the flange 17. The interior unillustrated flange includes a circular rear plate (not shown) parallel to the circular plate 16 and having welded thereto an arm 21 (FIG. 3) of a bracket 22 having another arm 23. A pivot pin 24 pivots together the two circular plates or discs 16 (and numbered) and thereby effects relative pivotal mounting between pedestal 11 and the bracket 22 between any number of positions of adjustment as, for example, the position illustrated in FIG. 1 in which an axis A of a variable speed motor 25 and its shaft 26 (FIG. 5) are disposed in a generally horizontal plane and the position illustrated in FIG. 4 in which the axis A is disposed in a vertical plane. Preferably, the holes or openings (unnumbered) in the inner flange (not shown) are positioned at approximately 10 degree intervals which allows the axis A to be adjusted every 10 degrees between the horizontal and the vertical to effect desired product discharge, as will be described more fully hereinafter.

Figure 3:
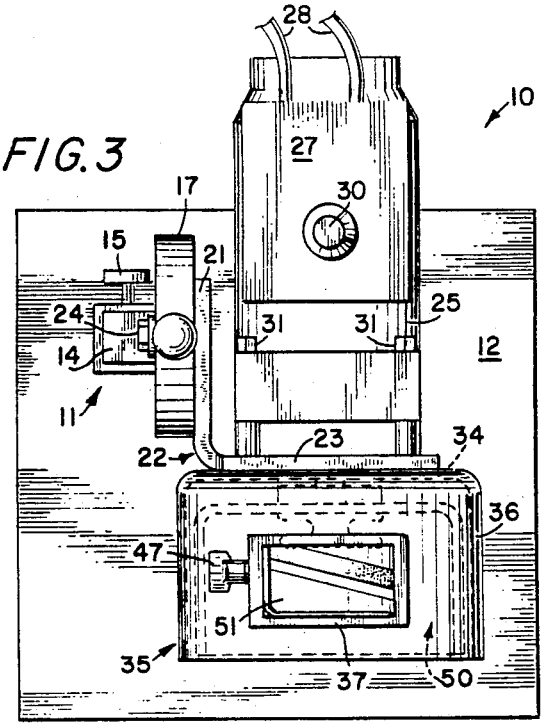
FIG. 3 is a top plan view of the slicing/shaving machine looking downwardly in FIG. 1, and illustrates a portion of a slicing/shaving blade carried by the slicing/shaving body visible through the product feed/-guide chute.

The variable speed motor 25 is also reversible, and an appropriate rheostat controlled ON-OFF reversing switch 27 is carried by the motor 25. The switch 27 is connected by conductors 28 to a suitable electrical source (not shown) and a switch arm 30 can be manipulated in a conventional manner to vary both the direction of rotation and the speed of the motor 25 and its shaft 26. The motor 25 is connected to the arm 24 of the bracket 22 by appropriate threaded bolts 31 (FIG. 3). The shaft 26 (FIG. 5) passes through a circular aperture or opening 32 in the arm 23 of the bracket 22 and also through a circular opening 33 in a circular rear portion 34 of a generally cylindrical housing 35 having a cylindrical body 36. The shaft 26 additionally includes a radially outwardly opening axially extending rectangular slot or keyway 39 (FIGS. 5 and 10) and a circular recess 38 (FIG. 10) which functions in a manner to be described more fully hereinafter.

Figure 6:
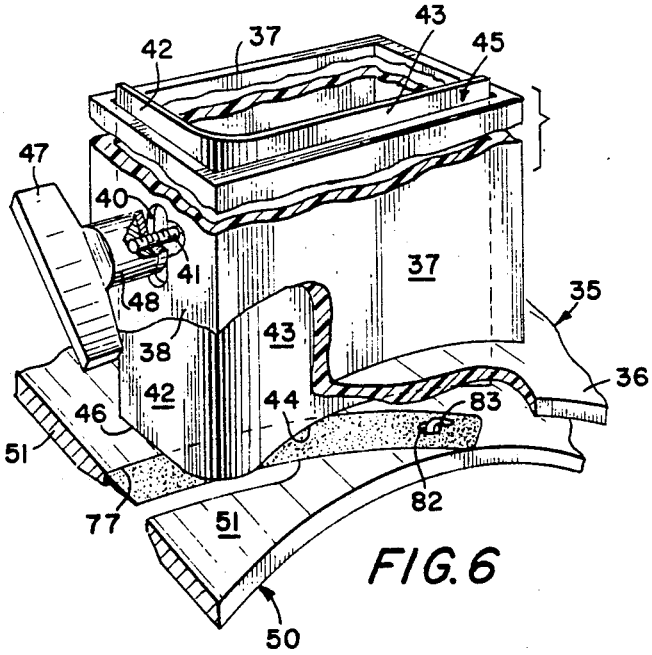
FIG. 6, which appears on the sheet of drawings containing

The housing 35 also includes an integral, tubular product guide or chute 37 which is generally of a rectangular transverse cross-sectional configuration (FIGS. 3 and 6). A wall 38 (FIG. 6) of the product guide 37 includes an elongated slot 40. The purpose of the elongated slot 40 is to permit the passage therethrough of a threaded stem 41 (FIG. 6) welded or otherwise fixed to and projecting from a plate portion 42 of a generally L-shaped product abutment plate 45 having another plate portion 43 which includes a lower cylindrical edge 44 which merges with a relatively straight lower edge 46 of the plate portion 42. The product abutment plate 45 can be positioned vertically within the product guide 37 within the limits afforded by the slot 40 and its abutment at the top and the bottom thereof with the threaded stem 41 for a purpose to be described more fully hereinafter. A manually rotatable handle 47 includes a generally cylindrical internally threaded stem 48 which can be rotated relative to the threaded stem 41 to draw the plate portion 42 of the product abutment plate 45 against the inner surface (unnumbered) of the wall 38 of the product guide 37 to retain the product assortment plate 45 in anyone of a plurality of a different positions of adjustment.

Figure 5:
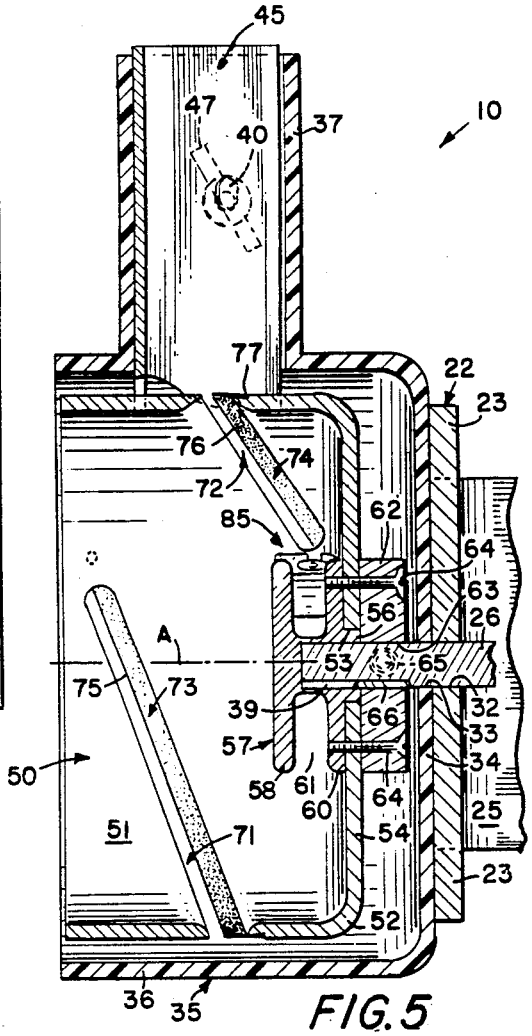
FIG. 5 is an enlarged fragmentary cross-sectional view taken generally along line 5—5 of FIG. 2, and illustrates a pair of slicing/shaving blades, each in partial overlapped relationship to a circumferential slot formed in the slicing/shaving body.

The slicing/shaving machine 10 further includes a slicing/shaving head 50 which includes a generally cylindrical slicing/shaving body 51 merging at a peripheral radius 52 with a circular rear wall or portion 54. The wall 54 includes a circular central aperture or opening 53 (FIG. 5) into which is received a cylindrical boss 56 (FIG. 5) of a gripping hub 57. The gripping hub 57 includes a relatively flat circular handle 58 spaced from a circular flange 60 by a radially outwardly opening peripheral groove 61. The flange 60 rests against an interior surface (unnumbered) of the circular rear portion or plate 54 and an annular plate 62 having a circular opening 63 which receives the shaft 26 is connected to the flange 60 by screws or bolts 64 which pass through openings (unnumbered) in the annular plate 62 and the circular rear plate or portion 54 and are threaded in threaded apertures (unnumbered) of the flange 60. The annular plate 62 carries a ball 65 of a ball detent which is biased radially outwardly by a spring (not shown) to project slightly within the opening 63 and engage in the recess 38 of the shaft 26 (FIG. 10) to thereby lock the slicing/shaving head 50 upon the shaft 26 with the keyway 39 snugly slidably receiving a key 66 (FIG. 5) welded to the plate 62 within the opening 63. As is best illustrated in FIG. 5, in order to remove the slicing/shaving head 50 from the shaft 26, the handle 58 is gripped by inserting one's thumb and fingers into the groove and pulling to the left, as viewed in FIG. 5, which causes the ball 65 to be forced against the bias of its spring (not shown) out of the circular recess 38 of the shaft 26 whereupon the entire slicing/shaving head 50 can be removed from the shaft 26. The slicing/shaving head 50 can be replaced upon the shaft 26 by merely aligning the key 66 with the keyway slot 39 and pushing the slicing/shaving head 50 back upon the shaft 26 which initially deflects the ball detent 65 inwardly until it reaches the recess 38 at which time the spring biases the ball 65 therein to again lock the slicing/shaving head 50 upon the shaft 26 for rotation therewith.

The slicing/shaving head 50 includes two generally identical relieved areas in the form of through slots 71, 72, each of which is disposed at an angle or obliquely to the axis A (FIG. 5) of the shaft 26 which, of course, when the slicing/shaving head 50 is mounted upon the shaft 26 is also the axis A of the slicing/shaving cylindrical body 51. Each of the slots 71, 72 extends over an arc of approximately 180° of the cylindrical body 51, as is most readily apparent from FIGS. 5 and 7 of the drawings. Associated with each slot 71, 72 is a respective slicing/shaving blade 73, 74 having a sharp slicing/shaving edge 75, 76, respectively. The cylindrical surface (unnumbered) of the slicing/shaving cylindrical body 51 is provided with a recess 77 (FIGS. 5 and 18, 9 and 12) of a depth corresponding generally to the thickest portion of the respective blade 73, 74. In this fashion a rear edge (unnumbered) of each blade 73, 74 opposite the sharp edge 75, 76 abuts a shoulder (unnumbered) along the length of the recess 77 to maintain each blade 73, 74 and its associated edge 75, 76 in its cutting position, particularly maintaining the cutting edges 75, 76 in a cylindrical plane corresponding to the exterior surface of the cylindrical body 51. The cylindrical body 51 is also tapered or raked slightly, as indicated by the angle 80 in FIGS. 11 and 12, at a side of the slot 71, 72 opposite the respective sharp edges 75, 76 to form a relief area 78. The relief area 78 allows the product to be sliced/shaved by the slicing/shaving edges 75, 76 with little or no drag and the extreme thin or shaved condition thereof due to the relief/relieved area 78 allows the slice/shave product to freely pass beyond the edges 75, 76 and through the slots 71, 72 into the interior of the slicing/shaving head 50 during the rotation thereof as, of course, food product is fed downwardly (as viewed in FIG. 5) through the feed chute 37 during the rotation of the slicing/shaving or cutting head 50.

Each of the blades 73, 74 is connected to the slicing/shaving head through apertures 81, 82 formed in opposite ends of each of the blades. The apertures 82 engage headed pins 83 (FIG. 9) welded to or integrally formed as part of the slicing/shaving cylindrical body 51. The other apertures 81 engage like headed pins 84 of a pair of slicing/shaving blade retaining and tensioning mechanisms 85 (FIGS. 8 and 21 through 24) secured to the interior of the slicing/shaving head 50 at approximately diametrically opposite positions thereof.

Figure 9:
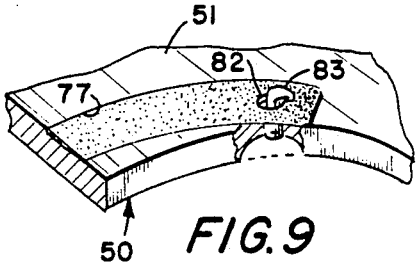
FIG. 9, which appears on the sheet of drawings containing
Figure 10:
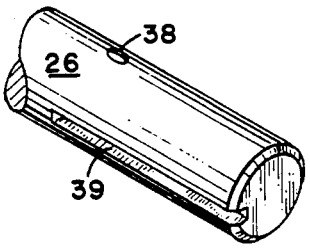
FIG. 10 is a fragmentary perspective view, and illustrates a shaft of the variable speed motor which includes a keyway and a detent for respectively locating and locking the slicing/shaving body relative to the shaft.
Figure 7:
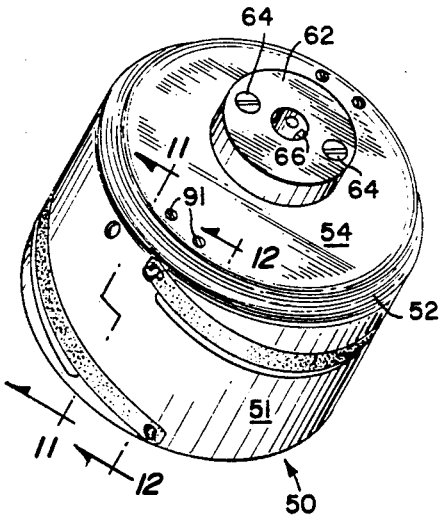
FIG. 7 which appears on the sheet of drawing containing
Figure 8:
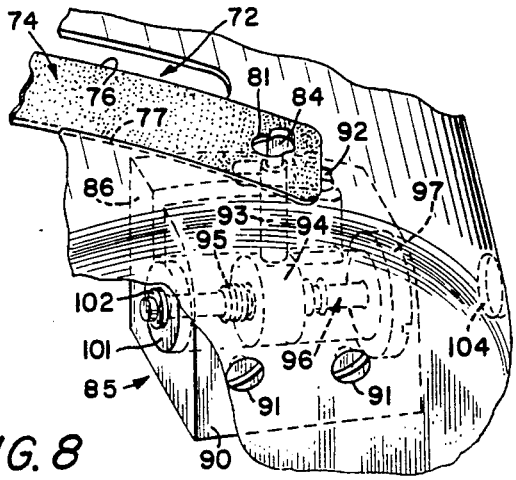
FIG. 8 is a fragmentary perspective view of a mechanism for securing an end of one of the slicing/shaving blades to the slicing/shaving body, and illustrates a pin carried by a threaded collar which in turn receives a screw for varying the tension of the slicing/shaving blade.

Each retaining and tensioning mechanism 85 includes a block or body 86 having an upper curved surface 87 (FIG. 23) conformed to and in engagement with an interior surface (unnumbered) of the cylindrical body 51. The upper curved surface 87 merges with a curved surface 88 (FIG. 24) which matches the interior surface (unnumbered) of the cylindrical body radius 52. The curved surface 88 in turn merges with a relatively flat surface 90 which engages the interior surface (unnumbered) of the circular rear portion 54 of the cylindrical body 51 and is secured thereto by a pair of screws 91 (FIGS. 7, 8 and 22). An elongated slot 92 formed in the cylindrical body 51 receives the associated headed pin 84 and a lower threaded portion 93 of each headed pin 84 is received in an internally threaded collar 94 which is in turn threaded upon a threaded portion 95 of a retention and tensioning screw 96 having a slotted head 97. The internal threaded collar 94 is free to slide in a cylindrical bore 98 of the body 86. The cylindrical bore 98 opens into a radial slot 100 which is aligned with the slot 92. An end of the screw 96 remote from the slotted head 97 passes freely through an externally threaded washer 101 which is threaded into a threaded portion (unnumbered) of a counterbore (unnumbered) of the bore 98. A conventional U-shaped retaining clip 102 retains the screw 99 in the bore 98 and permits free relatively rotation therein. A relatively large opening 104 is formed in the cylindrical wall 51 (FIGS. 22 and 23) in alignment with the axis of the screw 96 to permit a screwdriver or like tool to be inserted through the opening 104 into engagement with the slotted head 97. As the screw 96 is rotated through the slotted head 97, the headed pin 84 can be moved to the left or right, as viewed in FIGS. 22 and 23, to respectively tighten or loosen the associated slicing/shaving blade 73, 74, it being kept in mind that the opposite end of the respective blade 73, 74 is retained by an associated fixed headed pin 83 (FIG. 9). In this fashion each slicing/-shaving blade 73, 74 is retained in tension between the associated headed pin 84 and the respective edges 75, 76 are each held precisely located relative to the associated slots 72, 73.

SLICING/SHAVING METHOD

The slicing/shaving method will be described by assuming that the slicing/shaving machine 10 is positioned as shown in FIGS. 1, 2, 3 and 5, namely, with the axis A of the shaft 26 and the slicing/shaving head 50 in a generally horizontal plane. Before energizing the variable speed motor 25, the product abutment plate 45 is adjusted, if necessary, to locate the surfaces 44, 46 in intimate but spaced relationship to the exterior surface of the cylindrical body 51 of the slicing/shaving head 50 and the exterior surfaces (unnumbered) of the slicing/-shaving blades 73, 74. As can be best appreciated from FIG. 5, in the absence of this adjustment or in the absence of the entire product abutment plate 45, there would be a relatively large gap between the interior surface (unnumbered) of the cylindrical body 36 of the housing 35 and the exterior cylindrical surface (unnumbered) of the cylindrical body 51 of the slicing/shaving head at the area of the product chute 37. During the rotation of the slicing/shaving head 50, the product being fed down the chute 37, in the absence of the product abutment plate 45, would tend to be dragged by the surface friction of the cylindrical body 51 during the rotation thereof toward and into this large gap resulting in binding, shattering and possible overheating of the motor. However, with the edges 44, 46 located in intimate spaced relationship to the exterior surfaces of the cylindrical body 51 and the blades 73, 74, the gap is eliminated and the lowermost edge of the product abuts the inner surface (unnumbered) of the product abutment plate 45 and is accurately and uniformly sliced/shaved by the sharp edges 75, 76 of the respective slicing/shaving blades 73, 74, respectively.

The switch arm 30 is pressed to its "ON" position and rotated to effect the desired speed of rotation of the shaft 26 and the slicing/shaving head 50 carried thereby. The rotation in this preferred embodiment of the invention is clockwise, as viewed in FIG. 2 of the drawing. The slicing/shaving edges 75, 76 thus rotate along a generally circular path of travel with the angle of each being other than parallel thereto because of the generally angular configuration of the blades 73, 74 relative to the axis A of the cylindrical body 51. As a food product descends through the product guide or chute 37, it is successively and progressively cut by the edges 75, 76, and the sliced/shaved product passes through the respective slots 71, 72 into the interior of the cylindrical body 51. The centrifugal force of the cylindrical body 51 drives the sliced/shaved product outwardly of the slicing/shaving head 51 at which point it will fall vertically upon, for example, a scale (not shown) forming part of the base 12 of the pedestal 11. The product can be virtually any product which is sliced/shaved, such as meat products which are formed into sandwiches, potato products which are formed into thin slices for subsequent frying, vegetables for salads, etc. In all cases, the slicing/shaving operation is preformed at extremely high speeds because of the nonreciprocal high speed rotation of the slicing/shaving head 50 and the blades 73, 74 carried thereby. Furthermore, accidental injury is minimized because the sharp edges 75, 76 are inacccessible from the interior of the slicing/-shaving cylindrical body 51 and, following conventional practice, the product is pushed down the product guide chute by a conventional product plunger (not shown). Furthermore, the length and size of the product guide or chute 37 is such as to prevent the person's hands and/or fingers and particularly one's fingertips from reaching the edges 75, 76 of the respective blades 73, 74 through the top of the chute 37. Thus, no matter the particular product which is to be sliced/shaved, the slicing/shaving blades 73, 74 and the particular size slicing/shaving drum 50 can be designed to achieve a specific end product of desired consistency, size, thickness, configuration, etc. at a relatively nominal cost compared to conventional slicing machines, particularly conventional reciprocating slicing machines with rotating circular cutting blades/edges.

If it is desired to have the sliced/shaved product discharged immediately upon being sliced/shaved, the inclination of the housing 35 can be changed in the manner heretofore described to a perfectly vertical orientation (FIG. 4) in which the product would drop directly upon the base 12 upon being sliced/shaved and discharged into the interior of the slicing/shaving head 50 through the slots 71, 72.

In further accordance with the inventive method, a product delivery chute 110 (FIG. 13) or 120 (FIG. 14) can be provided as accessories. The product delivery chute 110 is constructed from plastic material and includes a serrated edge 111 and a circular opening 112 remote therefrom with a body 113 progressively tapering between the serrated edge 111 and the opening 112. The individual serrations (individually unnumbered) of the serrated edge 111 are designed to resiliently snap-fit into the gap (unnumbered) between the cylindrical bodies 35, 51 and clamp against the interior surface (unnumbered) of the housing body 36. Thus, as the product is discharged from the rotating slicing/shaving body 51, the product will flow into and through the product delivery chute 113 with the smaller tapered opening 112 offering a greater degree of guiding accuracy than afforded by the discharge of the product directly from the rotating head 50 which, because of the centrifugal force, tends to discharge the product in a more random indiscriminate fashion than might be desired. Obviously, since the product delivery chute 110 is nonrotatable and forms an extension of the housing 35, the product discharging the slicing/shaving head 50 is not subject to centrifugal force and simply progressively drops from the opening 112 in an accurate manner.

The product delivery chute 120 (FIG. 14) is also preferably constructed from plastic material and includes a plurality of exterior valleys 114 and peaks 115 with the valleys 114 forming a plurality of internal generally parallel shoulders 116. The product delivery chute 120 tapers from a larger end 117 toward a smaller discharge end 118. Because of the flutes 114, the product delivery chute 120 can be circumferentially constricted slightly and inserted in the gap between the cylindrical bodies 36, 51 and held thereat by the natural inherent resiliency or spring-back characteristics of the plastic material of the product delivery chute 120. Obviously, the sliced product is not subject to centrifugal force during the rotation of the slicing/shaving head 50 and, thus, will discharge the outlet 118 in a precise fashion with, of course, frictional sliding forces being reduced because of the limited contact afforded the sliced/shaved product by the line contact thereagainst by the shoulders 116, as opposed to the total surface contact of the product delivery chute 110.

In further accordance with this invention, the slicing/shaving machine 10 can be utilized to simultaneously slice/shave two or more different products, and this is preferably accomplished through the utilization of a product feed insert 130 formed of a single piece of plastic material having two generally tubular feed channels 131, 132 opening through a bottom cylindrical surface 133 curved to the curvature of the exterior surface (unnumbered) of the slicing/shaving cylinder body 51. A threaded stem 134 projects from the product feed insert 130 and is designed to be located in the slot 40 of the product guide 37 and locked in any desired position by the handle 47 (FIG. 6). When the product feed insert 130 is utilized, the product abutment plate 45 is essentially redundant and need not be utilized. A product plunger device 135 includes a handle 136 and a pair of generally cylindrical plungers 137, 138 corresponding in size and aligned with the respective tubular feed channels 131, 132.

Assuming, for example, that the slicing/shaving machine 10 was being utilized in a "deli," and one wished to slice ham and cheese for a ham and cheese sandwich or pastrami and corn beef for a pastrami/corn beef combo sandwich, the operator would insert ham and cheese in the respective feed channels 131, 132 or pastrami and corn beef in the respective channels 131, 132, energize the motor 25 to effect rotation of the slicing/-shaving head 50 and push the latter food products downwardly in the feed channels 131, 132 simultaneously manually or through the utilization of the plunger device 135 by, obviously, inserting the plungers 137, 138 in the respective tubular feed channels 131, 132 and applying sufficient force to slice/shave the desired amount of product.

It will be appreciated that as one single edge 75 or 76 of one of the blades 72, 73, respectively, is rotated initially toward and against and subsequently totally through a lower face of the product (not shown) within the product guide or chute 37, the edge 75 or 76 will progressively and eventually totally slice or shave an extremely thin slice of the product from the bottom face. If, as an example, the transverse cross-sectional size of the product in the chute 37 was 2"×4" of a predetermined thickness would be the end result of one pass of one of the edges 75, 76 through the face of the product. However, instead of a slice 2"×4", it is at times desirable to slice such thin slices into strips, and the latter is achieved through the utilization of a slicing and shaving head 150 which includes components identical to those of the slicing/shaving head 50 which have been so identically numbered and primed. In addition to the slicing/shaving head 150 having a cylindrical slicing/shaving body 51', associated slots 71', 72' and associated slicing/shaving blades 73', 74', the cylindrical body 51, 51' includes a plurality of through slots 151 positioned in parallel relationship to each other and axially offset from each other along the axis A of the cylindrical body 51'. A generally rectangular slicing blade 152, corresponding generally to a shaving blade, having a cutting edge 153 is positioned in each of the slots 151 and is retained therein by a set screw 154 (FIG. 17) threaded in a threaded bore (unnumbered) of a flange 155 which bears against the associated circumferential slicing blade 152 and forces the same against a back-up flange 156 (FIG. 17). The cutting edges 153 are virtually tangential to the exterior surface (unnumbered) of the cylindrical body 51 with each edge converging toward the cylindrical surface in the direction of rotation which in FIG. 16 is counterclockwise. As the slicing/shaving head 151 rotates counterclockwise, the edges 75, 76 of the respective slicing/shaving blades 73, 74 will, in the last example given, each progressively slice a 2"×4" thin slice from the bottom face of the product being fed in the product guide chute 37. However, simultaneously, the bottom face of the product is also sliced by the sharp edges 153 of the blades 151. If the blades 152 were spaced ¼" from each other, this would result in a series on ¼" strips being cut across each 2"×4" slice. Thus, in this fashion, cutting is achieved in two planes generally normal to each other, as defined by a plane through any one of the blades 73, 74 and a plane through any one of the blades 152 which results in essentially the simultaneous slicing/shaving of a thin slice of the product and its simultaneous slicing or severing into strips.

Figure 19:
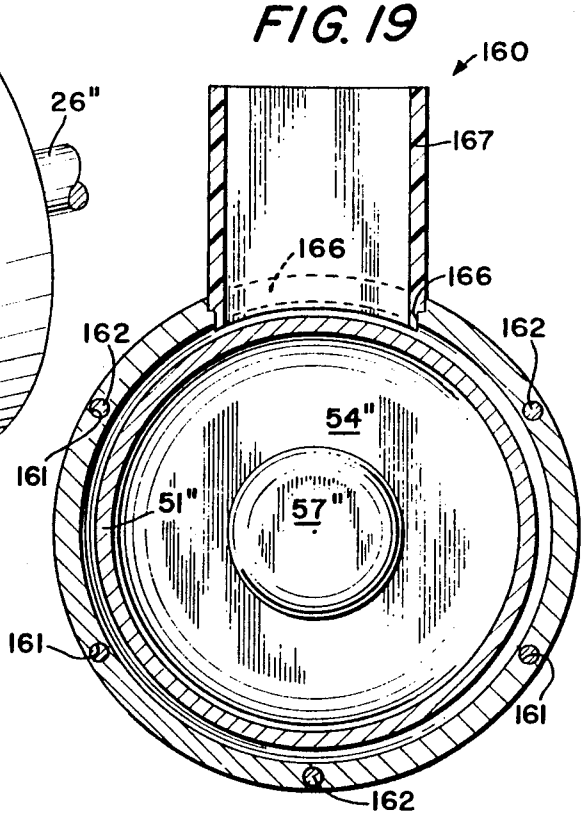
FIG. 19 is a cross-sectional view taken generally along line 19—19 of FIG. 18, and illustrates heating elements carried by a housing of the slicing/shaving machine of FIG. 18.
Figure 18:
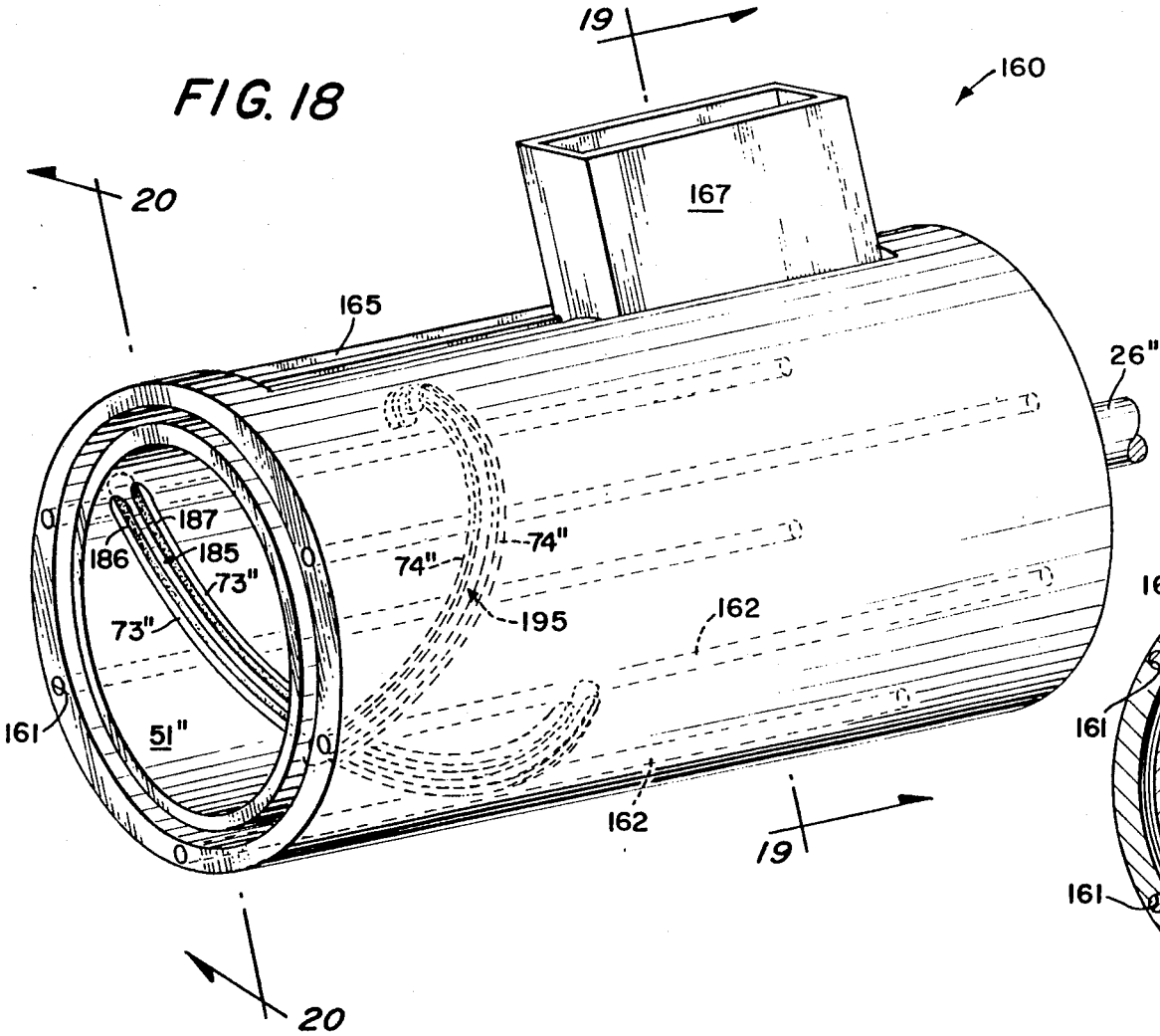
FIG. 18 is a perspective view of another slicing/shaving apparatus or machine of the present invention, and illustrates a heated housing and a product guide/chute slidable relative thereto.

In further accordance with the present invention, it is proposed to essentially simultaneously heat the product during the slicing thereof, and this can be done by, for example, incorporating resistance (Cal rod) heaters in the cylindrical wall or body 36 of the housing 35 or in the cylindrical wall or body 51 of the slicing head 50 or in both (not shown). In such case or cases the exterior of the housing 35 is preferably insulated so that heat is retained internally thereof. This would allow a product, such as pastrami or corn beef, to be simultaneously sliced and heated, subsequently made into hot corn beef or hot pastrami sandwiches, and this, obviously, could be done without the conventional "steaming" or microwave heating of the product as is now presently practiced. This would permit a limited heating of the sliced/shaved product because, of course, the product would not be in direct contact with the heated surfaces over a considerable length of time, and in order to slice/shave products at relatively elevated temperatures (140° F. to 240° F. or higher), a novel apparatus 160 (FIGS. 18 through 20) is provided with components thereof corresponding to the components of the apparatus 10 being identically numbered and double primed. Furthermore, the apparatus 160 is not only constructed and arranged to increase the temperature of the product incident to the slicing/shaving operation, but also permits the product to be sliced/shaved in either direction of rotation of a drive shaft 26" which can rotate a slicing/shaving heading 50" clockwise or counterclockwise.

The slicing/shaving machine 160 includes a housing 35" having a circular rear portion 34" and a cylindrical wall 36". The cylindrical wall 36" has five cylindrical generally parallel bores 161 formed therein and each bore houses a resistance heater or Cal rod 162 connected by wires 163 (FIG. 20) to a source of electric energy. An upper portion of the cylindrical body or wall 36" of the slicing/shaving head 160 is provided with a rectangular elongated slot 165 which slidably receives a lower edge 166 of a separate slidable product guide or chute 167 into which a product which is to be sliced/shaved is inserted in the manner heretofore described.

A slicing/shaving head 50'' having a cylindrical body or wall 51'' is carried by the shaft 26'' (FIG. 20) in the manner heretofore described. The cylindrical body 51'' is essentially identical to the cylindrical body 51 except the latter is actually shorter than the former and slots 73'', 73'' and 74'', 74'' are arranged in adjacent pairs which are parallel to each other and are on opposite sides of respective bridging wall portions 183, 184. A blade 185 overlies and spans the bridging wall portion 183 and includes opposite honed sharp edges 186, 187, each generally overlying one of the slots 73'', 73''. A like blade 195 having opposite sharp honed edges 196, 197 overlies the bridging wall portion 184 with the sharp edges 196, 197 each overlying one of the arcuate slots 74'', 74''. In one direction of rotation of the slicing/shaving head 50'', the product is cut by the edges 186, 196 while opposite rotation of the slicing/shaving head 50'' causes the product to be sliced by the blades 187, 197. This provides several advantages, namely, a single blade with two cutting edges has a theoretical life twice that of a single blade having a single edge. However, more importantly is the fact that the edges 185, 187 can be honed at different angles relative to each other. For example, if the edges 185, 196 were honed at one identical angle and the edges 187, 196 were honed at another and different angle, the distance of the edges above the relieved or raked surface 78'', illustrated in exaggerated form in FIG. 20, would differ and because of this rotation in opposite directions would achieve different thicknesses of sliced/shaved product without in any fashion altering the tension of the slicing/shaving blades 185, 195.

Obviously, during the operation of the slicing/shaving machine 160, the product guide chute 167' is slid back and forth in the slot 165 and when in the right-hand most position (FIG. 20), the entire surface of the product in the chute 167' lies against and is heated by the cylindrical wall 51'' of the slicing/shaving head 50''. The product is, therefore, heated while bearing against the unslotted portion (unnumbered) of the cylindrical body or wall 51'' and during its movement to the left, as viewed in FIG. 20, and its subsequent return to the position illustrated in FIG. 20. This substantially elevates the temperature of the food product beyond that afforded by the apparatus 10 utilizing the fixed product guide chute 37 and the axially shorter slicing/shaving head 50. The greater heat assures higher temperatures effective to preclude bacterial contamination while at the same time maintaining relatively high speeds of slicing/shaving.

Although a preferred embodiment of the invention has been specifically illustrated and described herein, it is to be understood that minor variations may be made in the apparatus without departing from the spirit and scope of the invention, as defined in the appended claims.

I claim:

1. A method of slicing/shaving a food product comprising the steps of providing a slicing/shaving edge of a generally arcuate configuration upon the exterior peripheral surface of a cylindrical drum, rotating the slicing/shaving edge along an arcuate path of travel with the slicing/shaving edge disposed at an oblique angle to the axis of said drum, and said slicing/shaving edge being in a cylindrical plane corresponding to the exterior peripheral surface of the cylindrical drum, and guiding a food product onto a relief area opposite said slicing edge, and then along a slicing/shaving edge whereby continuous rotation of the slicing/shaving edge along the arcuate path effects continuous slicing/shaving of the fed food product.

2. The slicing/shaving method as defined in claim 1 wherein the circular path of travel is about an axis, and the food product feed path is disposed generally transversely to the axis of the circular path of travel.

3. The slicing/shaving method as defined in claim 1 wherein the circular path of travel is about an axis, and the food product feed path is disposed generally normal to the axis of the circular path of travel.

4. The slicing/shaving method as defined in claim 1 wherein the circular path of travel is in a predetermined direction, the slicing/shaving edge has leading and trailing edge portions relative to the predetermined direction of circular path of travel, and the leading edge portion and predetermined direction set-off an acute angle therebetween.

5. The slicing/shaving method as defined in claim 1 including the step of heating the food product incident to the slicing/shaving thereof.

6. The slicing/shaving method as defined in claim 1 wherein the slicing/shaving edge circular path of travel is radially outboard of a generally cylindrical reference surface, and the radial distance between the circular path of travel and the cylindrical reference surface establishes the depth of cut of the slicing/shaving edge.

7. The slicing/shaving method as defined in claim 1 wherein the slicing/shaving edge circular path of travel is radially outboard of a generally cylindrical reference surface, the radial distance between the circular path of travel and the cylindrical reference surface establishes the depth of cut of the slicing/shaving edge, and selectively varying the radial distance between the circular path of travel and the cylindrical reference surface to vary the depth of cut.

8. The slicing/shaving method as defined in claim 1 wherein the slicing/shaving edge circular path of travel is radially outboard of a generally cylindrical reference surface, the radial distance between the circular path of travel and the cylindrical reference surface establishes the depth of cut of the slicing/shaving edge, and passing the sliced/shaved food product radially inwardly through the cylindrical reference surface.

9. The slicing/shaving method as defined in claim 1 wherein the slicing/shaving edge circular path of travel is radially outboard of a generally cylindrical reference surface, the radial distance between the circular path of travel and the cylindrical reference surface establishes the depth of cut of the slicing/shaving edge, selectively varying the radial distance between the circular path of travel and the cylindrical reference surface to vary the depth of cut, and passing the sliced/shaved food product radially inwardly through the cylindrical reference surface.

10. The slicing/shaving method as defined in claim 1 including the step of heating the sliced/shaved food product during and after the slicing/shaving thereof.

11. The slicing/shaving method as defined in claim 2 wherein the circular path of travel is in a predetermined direction, the slicing/shaving edge has leading and trailing edge portions relative to the predetermined direction of circular path of travel, and the leading edge portion and predetermined direction set-off an acute angle therebetween.

12. The slicing/shaving method as defined in claim 2 including the step of heating the food product incident to the slicing/shaving thereof.

13. The slicing/shaving method as defined in claim 2 wherein the slicing/shaving edge circular path of travel is radially outboard of a generally cylindrical reference surface, and the radial distance between circular path of travel and the cylindrical reference surface establishes the depth of cut of the slicing/shaving edge.

14. The slicing/shaving method as defined in claim 2 wherein the slicing/shaving edge circular path of travel is radially outboard of a generally cylindrical reference surface, the radial distance between the circular path of travel and the cylindrical reference surface establishes the depth of cut of the slicing/shaving edge, and selectively varying the radial distance between the circular path of travel and the cylindrical reference surface to vary the depth of cut.

15. The slicing/shaving method as defined in claim 2 wherein the slicing/shaving edge circular path of travel is radially outboard of a generally cylindrical reference surface, the radial distance between the circular path of travel and the cylindrical reference surface establishes the depth of cut of the slicing/shaving edge, and passing the sliced/shaved food product radially inwardly through the cylindrical reference surface.

16. The slicing/shaving method as defined in claim 2 wherein the slicing/shaving edge circular path of travel is radially outboard of a generally cylindrical reference surface, the radial distance between the circular path of travel and the cylindrical reference surface establishes the depth of cut of the slicing/shaving edge, selectively varying the radial distance between the circular path of travel and the cylindrical reference surface to vary the depth of cut, and passing the sliced/shaved food product radially inwardly through the cylindrical reference surface.

17. The slicing/shaving method as defined in claim 4 including the step of heating the food product incident to the slicing/shaving thereof.

18. The slicing/shaving method as defined in claim 4 wherein the slicing/shaving edge circular path of travel is radially outboard of a generally cylindrical reference surface, and the radial distance between the circular path of travel and the cylindrical reference surface establishes the depth of cut of the slicing/shaving edge.

19. The slicing/shaving method as defined in claim 4 wherein the slicing/shaving edge circular path of travel is radially outboard of a generally cylindrical reference surface, the radial distance between the circular path of travel and the cylindrical reference surface establishes the depth of cut of the slicing/shaving edge, and selectively varying the radial distance between the circular path of travel and the cylindrical reference surface to vary the depth of cut.

20. The slicing/shaving method as defined in claim 4 wherein the slicing/shaving edge circular path of travel is radially outboard of a generally cylindrical reference surface, the radial distance between the circular path of travel and the cylindrical reference surface establishes the depth of cut of the slicing/shaving edge, and passing the sliced/shaved food product radially inwardly through the cylindrical reference surface.

21. The slicing/shaving method as defined in claim 4 wherein the slicing/shaving edge circular path of travel is radially outboard of a generally cylindrical reference surface, the radial distance between the circular path of travel and the cylindrical reference surface establishes the depth of cut of the slicing/shaving edge, and selectively varying the radial distance between the circular path of travel and the cylindrical reference surface to vary the depth of cut, and passing the sliced/shaved food product radially inwardly through the cylindrical reference surface.

22. The slicing/shaving method as defined in claim 11 wherein the slicing/shaving edge circular path of travel is radially outboard of a generally cylindrical reference surface, and the radial distance between the circular path of travel and the cylindrical reference surface establishes the depth of cut of the slicing/shaving edge.

23. The slicing/shaving method as defined in claim 22 wherein the slicing/shaving edge circular path of travel is radially outboard of a generally cylindrical reference surface, the radial distance between the circular path of travel and the cylindrical reference surface establishes the depth of cut of the slicing/shaving edge, and selectively varying the radial distance between the circular path of travel and the cylindrical reference surface to vary the depth of cut.

24. The slicing/shaving method as defined in claim 22 wherein the slicing/shaving edge circular path of travel is radially outboard of a generally cylindrical reference surface, the radial distance between the circular path of travel and the cylindrical reference surface establishes the depth of cut of the slicing/shaving edge, and passing the sliced/shaved food product radially inwardly through the cylindrical reference surface.

25. The slicing/shaving method as defined in claim 22 wherein the slicing/shaving edge circular path of travel is radially outboard of a generally cylindrical reference surface, the radial distance between the circular path of travel and the cylindrical reference surface establishes the depth of cut of the slicing/shaving edge, selectively varying the radial distance between the circular path of travel and the cylindrical reference surface to vary the depth of cut, and passing the sliced/shaved food product radially inwardly through the cylindrical reference surface.

26. The method of slicing/shaving a food product comprising the step of providing a slicing/shaving edge of a generally arcuate configuration upon the exterior peripheral surface of a cylindrical drum, rotating the slicing/shaving edge along a circular path of travel with the slicing/shaving edge disposed at an oblique angle to the axis of said drum, and said slicing/shaving edge being in a cylindrical plane corresponding to the exterior peripheral surface of the cylindrical drum, guiding a food product along a first food product feed path and onto a relief area opposite said slicing edge, said first food product feed path disposed generally transversely to the slicing/shaving edge whereby continuous rotation of the slicing/shaving edge along the circular path effects continuous slicing/shaving of the fed food product, and guiding the food product along a second food product feed path and onto said relief area, said second food product feed path disposed generally transversely to said slicing/shaving edge whereby continuous rotation of said slicing/shaving edge along the circular path effects continuous slicing/shaving of the fed food product.

27. The slicing/shaving method as defined in claim 26 including the step of heating the food product during movement thereof along the second food product feed path.

28. A method of slicing/shaving a food product comprising the steps of providing a slicing/shaving edge upon the exterior peripheral surface of a cylindrical drum, said edge being in a cylindrical plane corresponding to the exterior peripheral surface of the cylindrical drum, rotating the slicing/shaving edge along an arcuate path of travel with the slicing/shaving edge disposed at an oblique angle to the axis of said cylindrical drum, and guiding a food product onto a relief area opposite said slicing edge, whereby continuous rotation of the slicing/shaving edge along the arcuate path effects continuous slicing/shaving of the fed food product.

29. The method of claim 28, further comprising slicing said food product into thin strips with a slicing blade having cutting edges that are perpendicular to the exterior peripheral surface of said cylindrical drum.

* * * * *

UNITED STATES PATENT AND TRADEMARK OFFICE

CERTIFICATE OF CORRECTION

PATENT NO. : 5,112,635

DATED : May 12, 1992

INVENTOR(S) : Benno E. Liebermann

It is certified that error appears in the above-identified patent and that said Letters Patent is hereby corrected as shown below:

Column 4, line 41, delete "he" and insert --the--

Column 5, line 1, delete "electonic" and insert --electronic--

Signed and Sealed this

Eleventh Day of January, 1994

Bruce Lehman

*Attest:*

BRUCE LEHMAN

*Attesting Officer*

*Commissioner of Patents and Trademarks*